US005542577A

United States Patent [19]

Friedrich

[11] Patent Number: 5,542,577

[45] Date of Patent: Aug. 6, 1996

[54] PLATE ASSEMBLY GRIPPING MEMBER

[76] Inventor: Peter W. Friedrich, 409 Fourth St., Apt. 1, Hoboken, N.J. 07030

[21] Appl. No.: 287,960

[22] Filed: Aug. 9, 1994

Related U.S. Application Data

[62] Division of Ser. No. 898,016, Jun. 12, 1992, Pat. No. 5,361,932.

[51] Int. Cl.[6] ..... B65D 23/10

[52] U.S. Cl. ..... 220/759; 220/755; 220/574.1

[58] Field of Search ..... 220/759, 769, 220/771, 755, 574, 574.1, 575, 556, 23.83, 23.86, 23.8, 914

[56] References Cited

U.S. PATENT DOCUMENTS

| | | | |
|---|---|---|---|
| D. 116,623 | 9/1939 | Lockwood . | |
| D. 211,532 | 6/1968 | Ashton . | |
| 556,200 | 3/1896 | McDonald . | |
| 602,324 | 4/1898 | Hautsch | 220/759 |
| 1,265,338 | 5/1918 | Jenks | 220/575 |
| 1,321,145 | 11/1919 | Price | 220/574 |
| 1,627,051 | 5/1927 | Moore | 220/574 |
| 1,901,837 | 3/1933 | Bateholts . | |
| 2,174,586 | 10/1939 | Leppke . | |
| 2,321,519 | 6/1943 | Rubinoff . | |
| 2,661,609 | 12/1953 | Revell | 220/755 |
| 2,719,414 | 10/1955 | Davis . | |
| 2,803,120 | 8/1957 | Wuerfel . | |
| 2,920,804 | 1/1960 | Minton . | |
| 3,059,809 | 10/1962 | Thompson, III | 220/769 |
| 3,099,377 | 7/1963 | Metzler et al. | 220/574 |
| 3,504,832 | 4/1970 | Corvetti . | |
| 3,955,672 | 5/1976 | Brundage . | |
| 4,461,396 | 7/1984 | Harper . | |
| 4,681,239 | 7/1987 | Manns et al. . | |
| 4,721,216 | 1/1988 | Kinder . | |
| 4,726,553 | 2/1988 | Wischusen, III . | |
| 4,732,274 | 3/1988 | Bouton . | |
| 4,823,958 | 4/1989 | Mahmud . | |
| 4,867,331 | 9/1989 | Task . | |
| 4,938,373 | 7/1990 | McKee . | |
| 4,986,434 | 1/1991 | Prestyly, Jr. | 220/574 |
| 5,058,737 | 10/1991 | Patterson et al. . | |
| 5,060,820 | 10/1991 | Boerner . | |
| 5,111,960 | 5/1992 | Zilliox . | |

FOREIGN PATENT DOCUMENTS

| | | | |
|---|---|---|---|
| 1000425 | 2/1952 | France . | |
| 5506 | 6/1827 | United Kingdom | 220/574.1 |

*Primary Examiner*—Stephen J. Castellano
*Attorney, Agent, or Firm*—Brumbaugh Graves Donohue & Raymond

[57] ABSTRACT

A vessel support and plate which allows the user to carry a plate, napkin, and drinking vessel in one hand. The assembly includes a drinking vessel support member, a napkin holding member, a plate member and a means to grasp the assembly. The vessel support member has a recess to receive the base of a drinking vessel. This recess has a mouth extending from its periphery to its center, allowing the supporting member to cradle stemware by its bowl, with the stem suspended therefrom. A tilted grip member attached to the plate allows the user to hold the device with minimal effort. A bulge cooperating with the grip member on the bottom surface of the plate allows the user to comfortably cradle the plate in the palm of the hand. The assembly further includes a member to detachably receive a napkin.

14 Claims, 4 Drawing Sheets

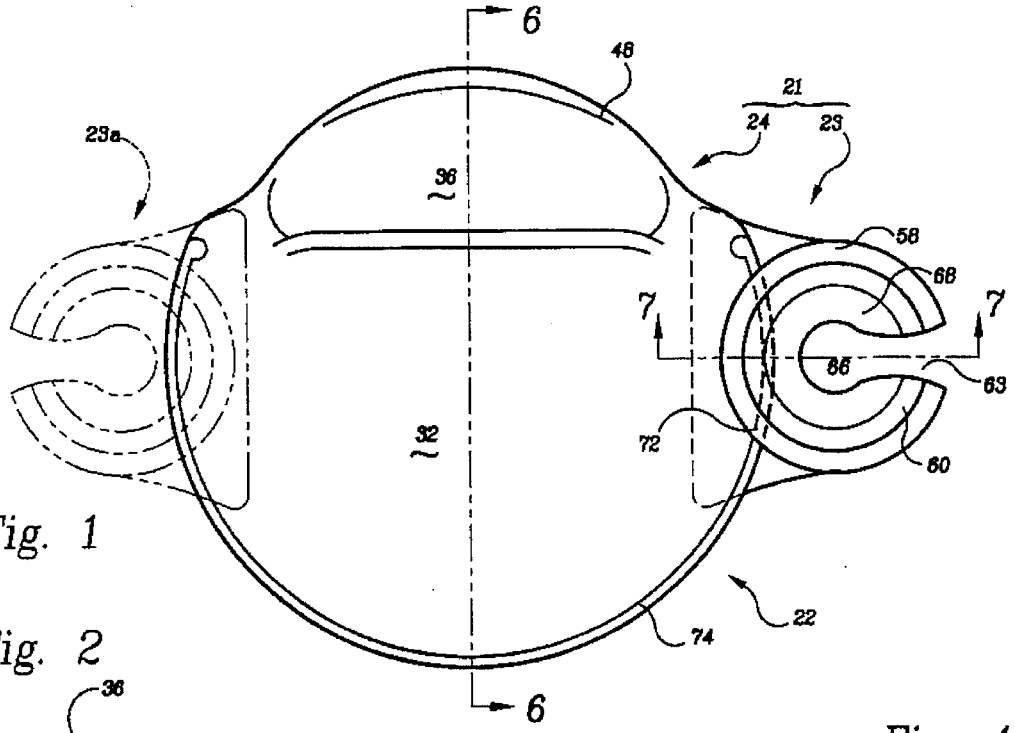
Fig. 1
Fig. 2
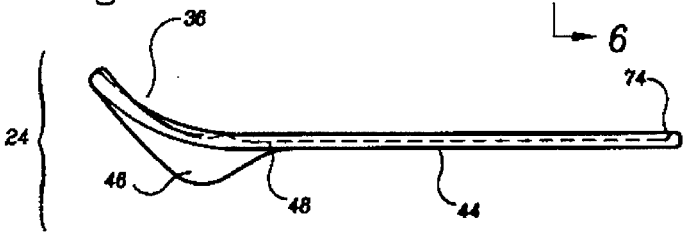
Fig. 4
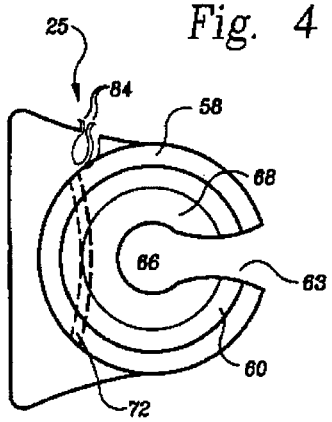
Fig. 3
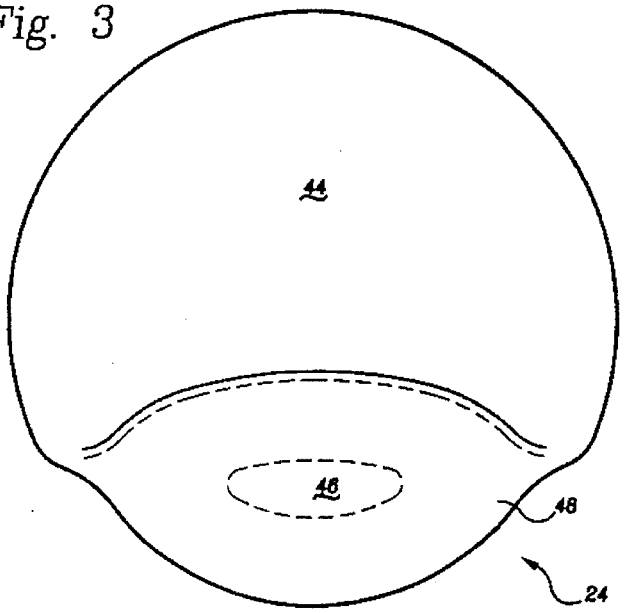
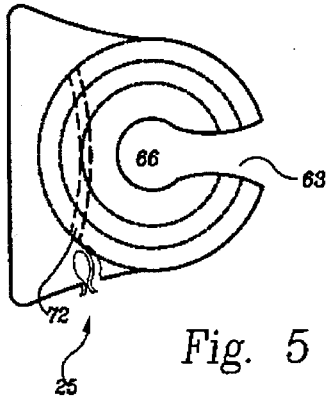
Fig. 5

Fig. 15
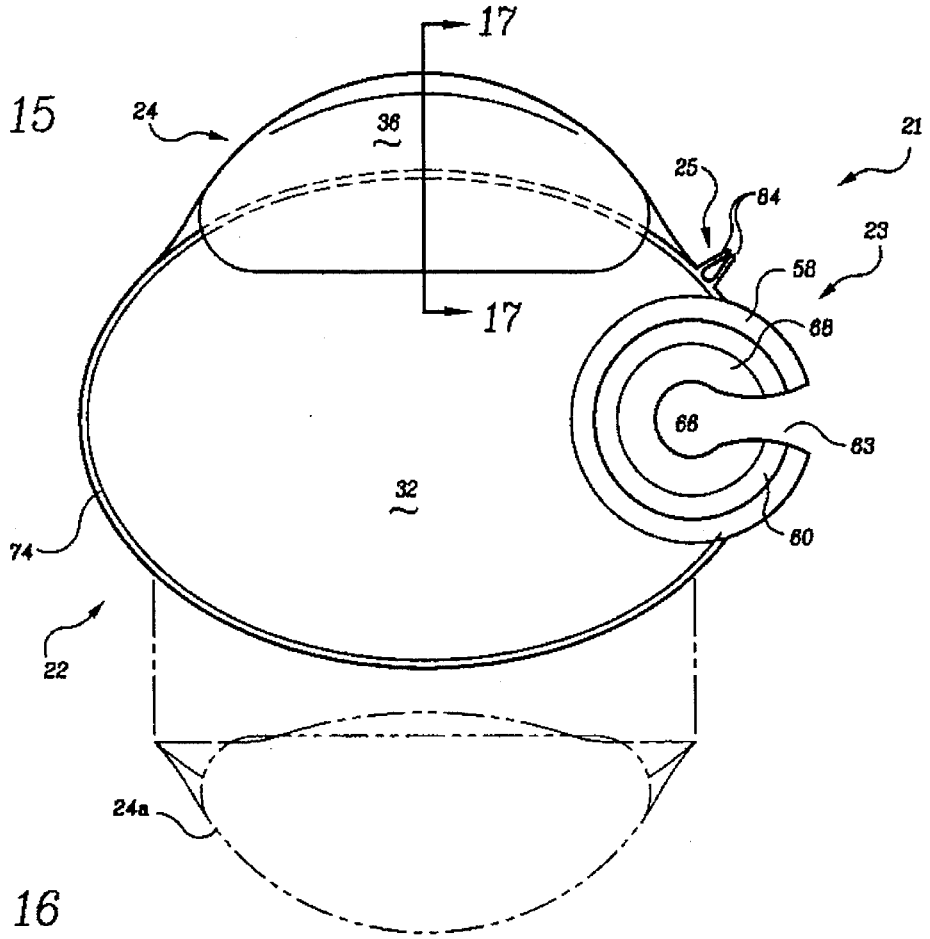
Fig. 16
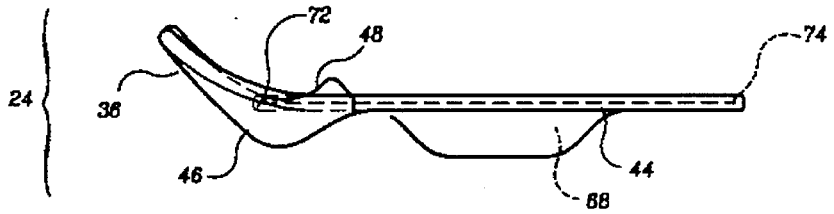
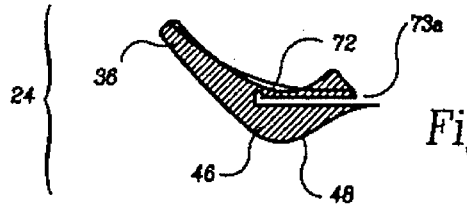
Fig. 17
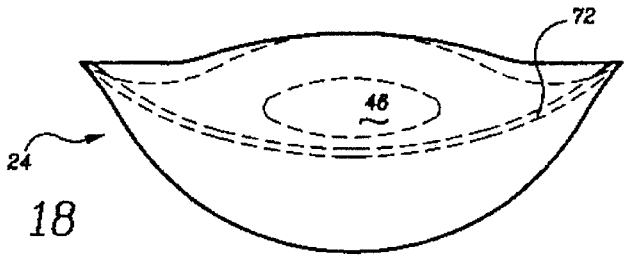
Fig. 18

PLATE ASSEMBLY GRIPPING MEMBER

This application is a division of application Ser. No. 07/898,016, filed on Jun. 12, 1992 now U.S. Pat. No. 5,361,932.

FIELD OF THE INVENTION

The invention relates to glassware supporting means and cooperating dishes to be used while being held in the hand.

BACKGROUND OF THE INVENTION

Formal dining occasions are often preceded by receptions, at which hors d'oeuvres and appetizers are served along with drinks while guests greet one another and converse.

This activity is conducted in a similar fashion at business receptions, buffets, as well as at informal picnics and barbecues.

The service of food and drinks to people who have no formal seating arrangement presents the problem of handling: 1) a plate holding food; 2) a drink; 3) a napkin; 4) a utensil; 5) a proper handshake when greeting another guest. In this situation, with a standard plate and drinking glass, the user would have both hands busy, and would need to carefully manipulate these items to free a hand for any other use, such as a handshake. As discussed further below, this problem has been addressed to a varying degree of satisfaction.

PRIOR ART

Prior art offers several adaptations of a dinner plate to support a drinking glass having a flat base within a recess.

These require the user's hand, wrist, and arm to be in an awkward position when holding such a plate and glass assembly for an extended period of time. Such discomfort is illustration that these offer no direct adaptation for hand-held use.

When a plate has additional food placed on it, this discomfort increases, since the additional weight is leveraged against the hand and wrist which, in turn, requires the grasping pressure of the hand to be increased, and the forearm muscles to work harder.

The situation may be further compounded by the use of stemware. Prior art provides a suitable support for a tumbler, but creates an unstable condition for stemware, as its center of gravity is far above the plate.

Users often place a napkin in one hand under the plate, thereby making access to the napkin more difficult. Grasping the napkin in this manner often causes a user to lose control of the plate, resulting in spilling of its contents.

Prior art also offers several adaptations of the underside of a dinner plate to enable the user to attach such a plate to a drinking glass at the rim of the glass. Such adaptations offer limited satisfaction, as an unbalanced plate would be unstable on the top of a drinking glass. Stability of this arrangement can be attained by numerous methods that provide a snug fit between plate and glass. When this connection is very snug, separating the two will be more likely to result in upsetting plate or drink. When frequent access to the drink is desired, the drink would be placed in a recess on top of the plate, however, stemware would again be in an unstable position. Also, the plate used in this manner would result in discomfort for reasons discussed above.

REFERENCES CITED

| Number | Date | Inventor | Class |
|---|---|---|---|
| U.S. Pat. No. D 116,623 | 9/1939 | Lockwood | |
| U.S. Pat. No. 2,920,804 | 1/1960 | Minton | 229/1.5 |
| U.S. Pat. No. D 211,532 | 6/1968 | Ashton | D44/10 |
| U.S. Pat. No. 3,504,832 | 4/1970 | Corvetti | 224/48 |
| U.S. Pat. No. 3,955,672 | 5/1976 | Brundage | 206/72 |
| U.S. Pat. No. 4,461,396 | 7/1984 | Harper | 220/22.83 |
| U.S. Pat. No. 4,732,274 | 3/1988 | Bouton | 206/561 |
| U.S. Pat. No. 4,823,958 | 4/1989 | Mahmud | 206/561 |
| U.S. Pat. No. 4,867,331 | 9/1989 | Task | 220/23.8 |
| U.S. Pat. No. 4,938,373 | 7/1990 | McKee | 220/23.86 |
| U.S. Pat. No. 5,058,737 | 10/1991 | Patterson, et al. | 206/217 |
| U.S. Pat. No. 5,060,820 | 10/1991 | Boerner | 220/574 |

DESCRIPTION OF PRIOR ART

U.S. Pat. No. Des. 116,623 Lockwood describes a food tray with several recesses for a drinking vessel and food. It is intended for tabletop use. Further, it is not adapted for hand-held use, and thereby would require the user's hand, wrist, and arm to be in an awkward position while holding a tray so described for an extended period of time. Positioning the hand in this fashion causes general muscular discomfort, strains, stress, or cramps in the hand and forearm. It does not accommodate stemware in a secure and stable manner.

U.S. Pat. No. 2,920,804 Minton describes a food serving tray with a central cup to receive a drinking glass. While this allows the user to hold both drink and food tray in one hand, it has no provision for stemware.

U.S. Pat. No. Des. 211,532 Ashton describes a food serving tray with a central cup similar to U.S. Pat. No. 2,920,804. This device does not include a means to hold a napkin. It also does not accommodate stemware.

U.S. Pat. No. 3,504,832 Corvetti describes a tray supported on the forearm by a central handle. The device does not provide recesses for drinking glasses or for stemware. Further, making its handle integral to the tray requires complex tooling. The handle also requires the hand to grasp it with thumb and fingers, and doing so for extended periods causes muscular discomfort described above.

U.S. Pat. No. 3,955,672 Brundage describes a drinking cup which passes through a plate, to be grasped and carried from below the plate. Grasping the cup indirectly provides stability to the plate. While this solves the problem of carrying both a drinking glass and plate, it provides no means to carry stemware. Also, it does not address holding a napkin, which is made more difficult as the plate is "balanced" on the user's forearm. It also complicates the matter of releasing the glass without losing control of the plate.

U.S. Pat. No. 4,461,396 Harper describes an adaptation of a dinner plate to support a drinking glass with a substantially flat base and several depressions, one of which is for a drinking vessel. Its adaptation for hand-held use is accomplished by providing an orifice to accept the user's thumb. Its provision for stemware is unstable, as the center of gravity of such a glass is far above the plate.

U.S. Pat. No. 4,732,274 Bouton describes a tray similar to U.S. Pat. No. 3,955,672. It differs by inclusion of a depending skirt.

U.S. Pat. No. 4,823,958 Mahmud describes a food serving tray with a central cup similar to U.S. Pat. No. 2,920,804 and U.S. Pat. No. Des. 211,532. This device does not include a means to hold a napkin. It also does not accommodate stemware.

U.S. Pat. No. 4,867,331 Task describes a plate similar to U.S. Pat. No. 4,823,958, with several pockets or depressions which carry either utensils or a drinking vessel. It also provides no means to carry stemware or hold a napkin.

U.S. Pat. No. 4,938,373 McKee describes a drinking cup with a plate that is secured above the orifice of the cup. While this solves a problem of carrying both a drinking glass and plate, it requires care when loading the plate to keep its contents balanced. Careful manipulation is required to provide access to: drink, food, napkin, and a free hand for greetings. When frequent access to the drink is desired, the drink would be placed on a recess on top of the plate, and the plate used thus would result in discomfort from the required grasp, for reasons discussed above.

U.S. Pat. No. 5,058,737 Patterson, et al. describes a drinking cup with a plate that is secured above the orifice of the cup similar to U.S. Pat. No. 4,938,373 in its employment. It differs by the methods used to latch plate and vessel together, but it has similar utilitarian problems, and requires complex tooling.

U.S. Pat. No. 5,060,820 Boerner describes a drinking cup with a plate that has a depending flap or handle with which one can grasp in one hand both the handle and the drink. Its use is similar to U.S. Pat. No. 4,938,373, but its grasping means has a more substantial size. This device may fail when the user exerts too little pressure on the depending handle, allowing the drinking vessel to drop from the user's grasp as a consequence.

OBJECT OF THE INVENTION

It is the object of this invention to:

a) provide a device to support drinking vessels, either with or without a stem, in a stable manner and support both food and drink, the combination to be held in one hand. Thus, the user is free to use the opposite hand for shaking hands, gesturing, raising the glass, or eating from the plate, and b) provide a grip on the periphery of such a plate suitably designed to be comfortable when held for an extended period of time, and c) provide secure support for a drinking vessel, so the user may support a tumbler, resting the base of the vessel within a recess formed on the top surface of the plate provided for such purpose, or support stemware, passing the stem of the drinking vessel through a slot, and resting the bowl of the glass in the cooperating depression provided for such purpose, and d) provide a holding member or device to grasp or secure a napkin and release it without causing instability of the plate or its contents.

BRIEF DESCRIPTION OF THE DRAWINGS

FIG. 1 is a top plan view of a plate assembly in accordance with the present invention;

FIG. 2 is a side elevational view thereof;

FIG. 3 is a bottom plan view thereof;

FIG. 4 is a plan view of a modified interlocking vessel support means in accordance with the present invention;

FIG. 5 is a bottom plan view thereof;

FIG. 15 is a top plan view of a further modified plate assembly in accordance with the present invention;

FIG. 16 is a side elevational view of a modified plate assembly of FIG. 15 in accordance with the present invention;

FIG. 17 is a partial sectional view of an interlocking grip extension of FIG. 15 in accordance with the present invention.

FIG. 18 is a bottom plan view of grip extension of FIG. 17.

PARTS LIST

Figure 6:
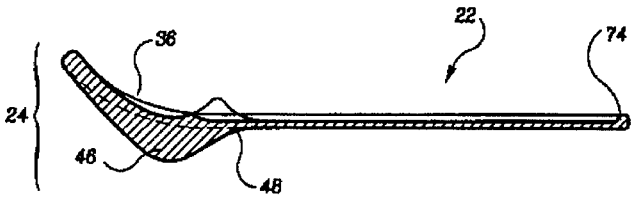
FIG. 6 is a section of plate assembly in FIG. 1 along line 6—6.

21, plate assembly
22, plate member formed by 32, 36, 44, 58
23, vessel support member formed by 58, 60, 63, 66, 68, 76
24, grip member formed by 36, 46, 48
25, means to hold a napkin
32, substantially flat or dished plate surface
36, upwardly tilted flange extension
44, underside of plate surface
46, downward extending bulge
48, elastomeric covering on grip
58, generally flat surface extending from edge of plate surface
60, flat annular depression in flat surface extending from edge
63, slot, bight, or opening
66, opening substantially concentric to annular depression
68, concave surface in annular depression
72, detent
73, slot in edge of support member
**73*a***, slot in edge of grip member
74, rim of plate
76, elastomeric covering of interior surfaces of bight
82 clip
84 opposing faces of clip 82
95 drinking vessel
97 drinking vessels (stemware)

DETAILED DESCRIPTION OF THE PREFERRED EMBODIMENT

Referring to the drawings, FIGS. 1–8, there is illustrated one embodiment of a serving plate assembly in accordance with the present invention generally designated by the numeral 21.

FIG. 1 illustrates a plate assembly 21 in plan view. As seen in this view, the plate assembly 21 consists of a plate member 22; and a separable, outwardly extending vessel support member 23 described in greater detail below.

FIG. 1 further illustrates the plate member 22, consisting of a substantially flat or dished plate surface 32 to support food 32, an upwardly tilted flange extension 36 connected to a surface, described in greater detail below, and a raised rim 74 on the outer periphery of the plate member 22.

Figure 7:
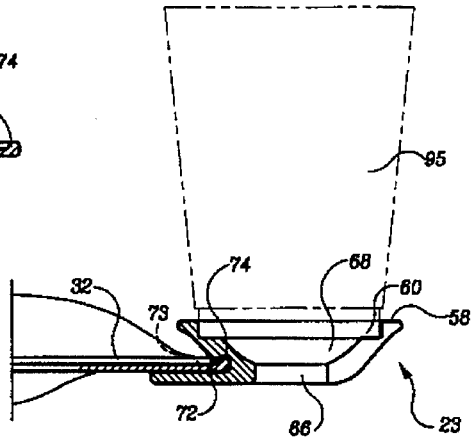
FIG. 7 is a fragmentary section thereof along line 7—7, with tumbler in place.

FIG. 1 also illustrates details of the separable vessel support member 23. The member consists of a generally flat surface 58 extending laterally from the edge of the plate surface 32, and a substantially flat annular depression 60 in the surface 58 to receive the base of a drinking vessel (not shown). The depression generally conforms to the base of a vessel such as a tumbler. FIG. 7 illustrates a drinking vessel 95 supported according to the above description. An alternate position for the vessel support member 23*a* shows orientation to a user's left hand.

Figure 8:
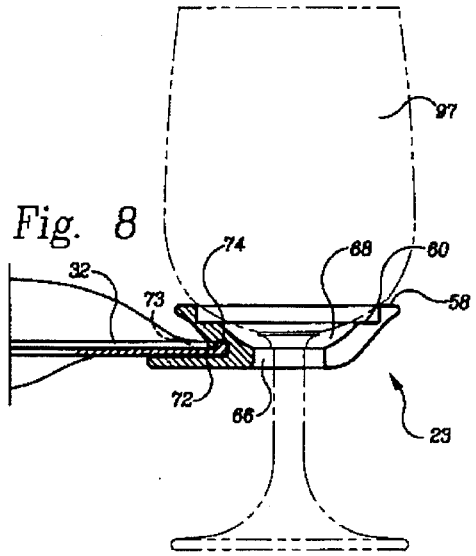
FIG. 8 is a fragmentary section thereof along line 7—7, with stemware in place.
Figure 10:
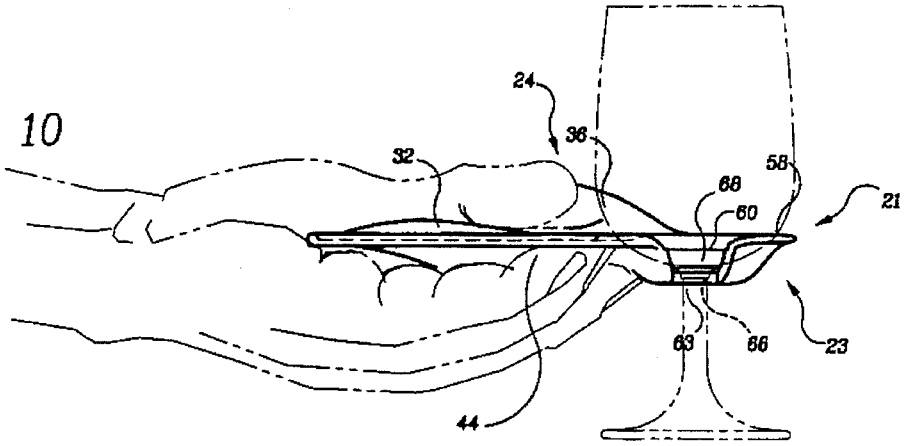
FIG. 10 is an elevational view thereof, as held in the hand.

FIGS. 7 and 8 show the separable support member 23 attached to the plate surface 32. When so disposed, the support member 23 lies in a plane generally parallel to the plane of plain surface 32.

FIG. 5 further illustrates the separable vessel support member 23 and means to attach to the plate member 22. The vessel support member 23 is separably attached by the elastic properties of the described support member cooperating with an integral detent or detents 72 within a slot 73 in the internal edge of the support member 23 and interlocking with a raised rim 74 on the plate member 22. The support member 23 is alternately separably attached by means of interlocking ribs, or similar hidden fastening hardware (not shown) communicating between the separable vessel support member 23 and the edge, underside, or rim of the plate member 22. The vessel support member 23 is, at the choice of the user, attached for use with the vessel support member oriented to the user's right hand, or reoriented to the user's left hand, or detached.

Returning to FIG. 1, the vessel support member 23 includes a slot, bight, or opening 63 extending from the external edge of the support member to an opening 66 substantially concentric to the annular depression 60. Bight 63 allows passage of the supporting stem member of a piece of stemware 97, shown more clearly in FIG. 8. The bowl of such vessels is thus supported by the surface of the depression 60. This allows the user to hold the plate assembly 21 in either hand and support the stemware 97 in a stable manner leaving the opposite hand free.

FIG. 8 illustrates the drinking vessel 97 so supported. A dished, conic, or otherwise concave surface 68 in the center of the depression 60 provides additional stability and support to the bowl of the stemware 97.

Referring to FIG. 2, the flange extension 36 cooperates with a downward extending bulge 46 on the underside 44 of the plate surface 44, to provide a grip member 24 for holding the plate assembly 21 in the hand. When the user holds the grip member 24 in the hand, this arrangement allows the user to cradle the plate assembly 21 in the palm of the hand while stabilizing the plate assembly 21 with the thumb communicating with the flange 36.

FIG. 2 further illustrates the plate assembly 21 in side elevation with additional detail of the features of the grip member 24. The grip member 24 is optionally covered or coated on the external surfaces by an elastomeric material 48. This is accomplished by co-injection in the case of an injection-molded plastic plate, or by dipping in vinyl or other elastomeric material in the case of ceramic, metal, wood or similar materials not suitable to the co-injection process. Further, the grip member 24 is optionally covered by elastomeric material that is adhered to the surface of the grip member. Further, the grip member is optionally covered by a separately molded elastomeric material secured to the grip member 24 by means of rivets, detents, or other concealed internal mechanical means.

FIG. 3 illustrates the plate assembly 21 in plan view from the underside, showing the contours relating to the topographical features of the downward extending bulge 46.

Referring to FIG. 4, the vessel support member 23 has a means to hold a napkin 25 or serviette and release it without causing the plate member 22 and its contents to upset. Holding means in this embodiment is integrally formed as a clip with opposing faces 84 providing pressure to grasp the napkin 25 by frictional force. The material used in forming the vessel support member 23 is an elastomeric material or a flexible substance such as steel or plastic to allow the clip 84 to flex repeatedly. Alternately, means is formed separately and assembled to the vessel support member 23 or another member of the plate assembly 21.

DETAILED DESCRIPTION OF ALTERNATE EMBODIMENT

Referring to the drawings, FIGS. 9–14, an additional embodiment of the plate assembly generally designated by the numeral 21, is illustrated in accordance with the present invention.

Figure 11:
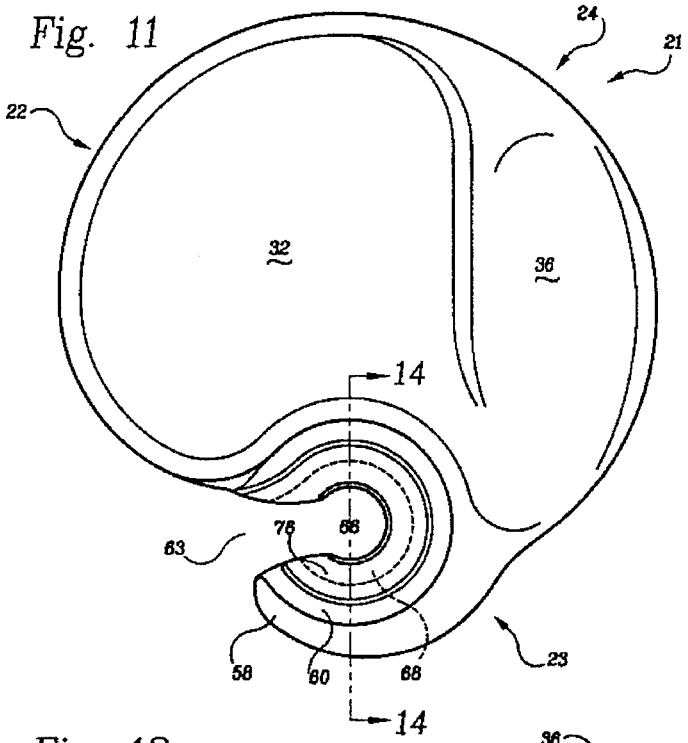
FIG. 11 is a top plan view of modified plate assembly of FIG. 9 in accordance with the present invention.

FIG. 11 illustrates the plate assembly 21 in plan view. Herein, the plate member 22 consists of the substantially flat or dished surface 32 to support food 32, an integral grip member 24, described in greater detail below, and an integral outwardly extending vessel support member 23 described in greater detail below.

Figure 9:
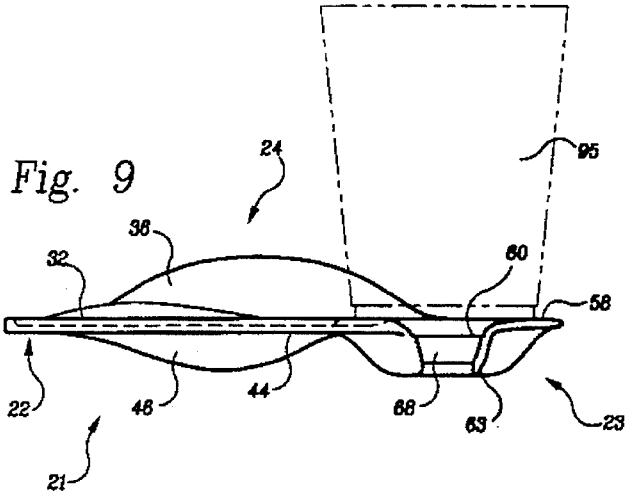
FIG. 9 is a front elevational view of a modified plate assembly in accordance with the present invention, with stemware in place.
Figure 14:
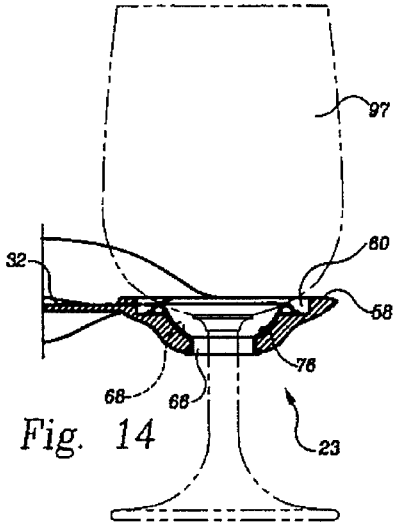
FIG. 14 is a partial sectional view along line 14—14 of FIG. 11 in accordance with the present invention.

The vessel support member 23 has features of the above described embodiment respectively numbered 60, 63, 66, 68 to receive a drinking vessel 95, 97. FIGS. 9 and 14 illustrate drinking vessels similarly supported, and the features listed above. The plane of the support member 23 is generally parallel to the plane of the plate surface 32, and consists of the generally flat surface 58 extending laterally from the edge of the plate surface 32.

FIG. 14 further illustrates a soft elastomeric covering, coating, or pad 76 on the interior edges and the surfaces 60, 66, 68 of the annular depression and the concave surface, providing cushion for the drinking vessel 95, 97, thus protecting crystal stemware from scratching during use. Locally inserted pads (not shown) are substituted in a circular array around the depression or the concave surface to accomplish the above purpose. The separable vessel support member 23 is optionally made in its entirety of elastomeric material.

Referring to FIG. 11, the integral grip member 24 consists of the upwardly tilted flange 36, and the downward extending bulge 46 on the underside 44 of plate surface 44 32. When the user holds the grip member 24 in the left hand, this arrangement cooperates to allow the user to cradle the plate assembly 21 in the palm of the hand while stabilizing the plate assembly 21 with the thumb communicating with the flange 36, and support the stemware in a stable manner while leaving the right hand free. This arrangement is shown more clearly in FIG. 10.

Figure 12:
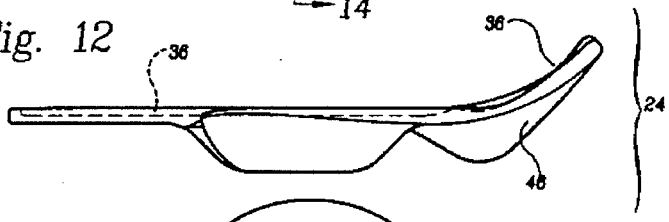
FIG. 12 is a side elevational view thereof.

FIG. 12 further illustrates the plate assembly 21 in side elevation with additional detail of features of the grip member 24. Grip member 24 is optionally covered or coated on external surfaces by an elastomeric material 48. This is accomplished in a manner similar to the first embodiment.

Figure 13:
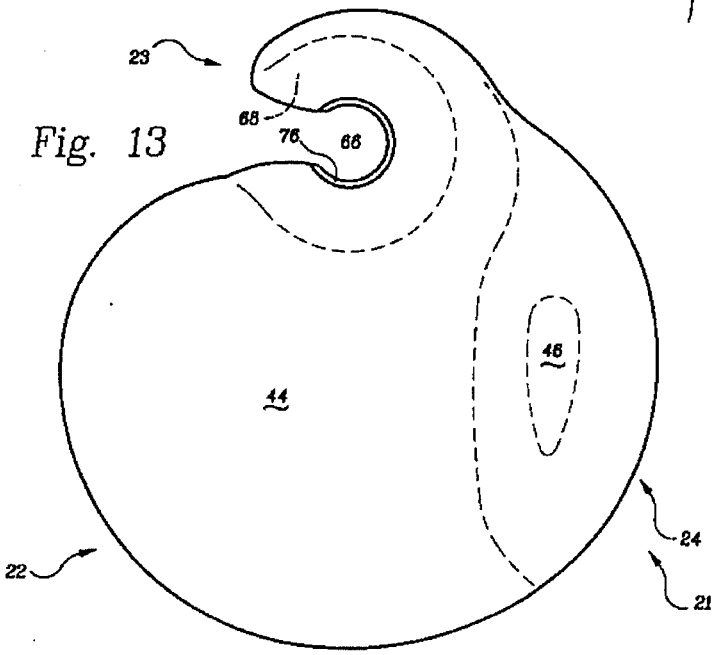
FIG. 13 is a bottom plan view thereof.

FIG. 13 illustrates the plate assembly 21 in plan view from the underside, showing contours relating to the topographical features of the downward extending bulge 46 and underside of the concave surface 68.

FIG. 11 further illustrates the vessel support member 23. The vessel support member 23 includes the slot, bight, or opening 63 extending from the external edge of the support member to the opening 66 substantially concentric to the annular depression 60. The bight 63 allows passage of the supporting stem member of the stemware 97. The bowl of such a vessel is thus supported by the surface of the depression 60. This arrangement is shown more clearly in FIG. 14. This allows the user to hold the plate assembly 21 in the left hand and support the stemware in a stable manner leaving the right hand free.

DETAILED DESCRIPTION OF THE SECOND ALTERNATE EMBODIMENT

Referring to the drawings, FIGS. 15–18, an additional embodiment of the plate assembly generally designated by the numeral 21, is illustrated in accordance with the present invention. Herein, the plate member 22 consists of the substantially flat or dished surface 32 to support food 32, and the integral outwardly extending vessel support member 23 described in greater detail below.

The plane of support member 23 is generally parallel to the plane of the plate surface 32, and consists of the generally flat surface 58 extending laterally from the edge of the plate surface 32. The support member 23 has features of above described embodiment respectively numbered 60, 63, 66, 68 to receive the base of drinking vessels 95, 97. FIGS. 7 and 8 illustrate drinking vessels so supported, and features similar to those listed above.

Referring again to FIGS. 15–18, the plate assembly 21 is provided with a separable grip member 24, consisting of the upwardly tilted flange 36, and the downward extending bulge on the underside 44 of the plate surface 44 32.

The grip member 24 is, at the choice of the user, attached for use with the vessel support member 23 oriented to the user's right hand, or re-oriented to the user's left hand, or detached. When the user holds the plate assembly 21 in either hand, this arrangement allows the user to cradle the plate assembly 21 in the palm of the hand while stabilizing the plate assembly 21 with the thumb communicating with the flange extension 36.

The grip member 21 is alternately separably attached by means of interlocking ribs, or similar hidden fastening hardware (not shown) communicating between the separable grip member 21 and the edge, underside, or rim of the plate member 22.

The above described separable grip is optionally covered or coated on external surfaces by the elastomeric material 48 for a more secure grasp, as in previously described embodiments, or is manufactured in its entirety of elastomeric material.

Referring to FIG. 17, the grip member 24 is separably attached by elastic properties of the described grip member 24 cooperating with the integral detent or detents 72 within a slot 73*a* in the edge of the member 24 and interlocking with the raised rim 74 on plate member (not shown).

The grip member 24 is alternately separably attached to the plate member 22 by means of interlocking ribs or other concealed internal mechanical means (not shown) communicating between the separable grasping mean and the edge, underside, or rim of the plate member 22.

Referring to FIG. 15, the plate assembly 21 has a means for temporarily holding the napkin 25 or serviette. Holding means in this embodiment is integrally formed as a clip with opposing faces 84 providing pressure to grasp the napkin 25 by frictional force. Holding means is alternately integral to the grip member 24.

The described embodiments are manufactured of numerous materials including, but not limited to, ceramics, plaster, paper, plastics, rubber, wood, metals, and glass.

The embodiments described are manufactured by numerous processes including, but not limited to, compression molding, injection molding, casting, and machining.

While a preferred embodiment of the invention has been described, it should be readily understood that those skilled in the art may find numerous variations, alterations, adaptations and modifications, and that these may be made without departing from the spirit of the invention and the scope of the following claims, and are intended to be covered thereby.

SUMMARY OF THE INVENTION

This invention successfully addresses the issues presented by combining functions required of a plate assembly for use at a reception.

The device improves utility over prior art by providing stable support for a drinking vessel, either with or without a stem. The device is an improvement over prior art as it specifically allows use with stemware. The user passes the stem of the drinking vessel through a slot, and rests the bowl in the cooperating depression provided for such purpose.

The plate assembly supports both food and drink in one hand in a comfortable and stable manner. The plate assembly is designed to be cradled in the palm of the hand with the thumb extended out and against an upwardly tilted flange, an arrangement which stabilizes the plate and reduces muscular stress as compared with more common designs which require the user to grasp the edge of such plates.

The grip located on the periphery of the plate assembly in combination with a bulge on the underside of the plate provides further comfort when held for an extended period of time.

The plate assembly's simple configuration allows easy manufacture in a wide variety of materials, as outlined below.

The device could be made of numerous materials, either rigid, such as ceramics, wood, metals, or glass, or more flexible materials such as plastics, rubber, paperboard, and the like. The assembly is designed to allow several of its parts to be made of differing materials to impart qualities such as:

a) modification of orientation, for example, reorientation for left-handed users;

b) cushioning crystal stemware;

c) provision for decorative features and color contrast;

d) provision for insulation;

e) holding means for napkin;

f) adaptation to specific drinking vessels.

OPERATION OF THE INVENTION

The invention as shown in the preferred embodiment offers a coordinated system to handle, in one hand, food, drink, and napkin at a cocktail reception. It offers the user movable components to allow orientation of the assembly for either hand. The position of such attachments is at the discretion of the user. Either or both the grasping means or the drinking vessel support member are firmly attached by interlocking detents with a raised rim on the plate using the elastic properties of the material of their manufacture.

The user cradles the plate in the palm of the hand and orients the drinking vessel support member toward the opposite hand. When extending the thumb to exert moderate lateral pressure on the upwardly tilted flange extension, the plate is stable for food and drink. The depending bulge on the underside of the plate fills the curve of the palm of a relaxed hand. This maintains stability while the fingers are extended and the hand is in a relaxed condition, thus offering comfort for an extended period of time.

A drinking vessel of substantially cylindrical shape can be supported by nesting the base of such a vessel in the flat annular depression provided within the horizontal surface extending from the plate assembly. Stemware is supported in the same annular depression by passing the supporting stem of such vessel into the bight and supporting the bowl with the stem extending through the bight near the center of the depression.

A napkin or serviette is optionally attached to the plate or one of its components by an extending clip or holding means.

One embodiment shown is intended for use in the left hand. The user cradles the plate in the palm of the left hand and orients the vessel support member toward the right hand. Operation is similar to the preferred embodiment, with emphasis for use to keep the right hand free for handshake greetings.

I claim:

1. A grip member for holding a plate in a hand comprising:

an upwardly tilted flange extending from the plate;

an extending bulge extending from the underside of the plate and cooperating with the upwardly tilted flange contoured for allowing the hand along a substantially circumferential arc of the plate to cradle the plate securely in the palm of the hand while stabilizing the plate with the thumb of the hand communicating with the upwardly tilted flange, wherein said grip member is separable from the plate.

2. The grip member according to claim 1, further comprising a detent extending in a slot in an edge of the grip member for interlocking a raised rim of the plate to the grip member.

3. A plate assembly for supporting articles and a vessel, comprising:

a plate member having a substantially flat surface and an underside; and a grip member separably attached to said plate member for holding the plate assembly in a hand and comprising an upwardly tilted flange extending from the plate member, an extending bulge extending from the underside of the plate member and cooperating with the upwardly tilted flange contoured for allowing the hand along a substantially circumferential arc of the plate assembly to cradle the plate assembly securely in the palm of the hand while stabilizing the plate assembly with the thumb of the hand communicating with the upwardly tilted flange.

4. The plate assembly according to claim 3, wherein the grip member further comprises a detent extending in a slot in an edge of the grip member for interlocking a raised rim of the plate member to the grip member.

5. A plate assembly for supporting articles and a vessel, comprising:

a plate member having a substantially flat surface an underside;

a grip member for holding the plate assembly in a hand and comprising an upwardly tilted flange extending from the plate member, an extending bulge extending from the underside of the plate member and cooperating with the upwardly tilted flange contoured for allowing the hand along a substantially circumferential arc of the plate assembly to cradle the plate assembly securely in the palm of the hand while stabilizing the plate assembly with the thumb of the hand communicating with the upwardly tilted flange; and a drinking vessel support member connected to a raised rim of the plate member and comprising a generally flat surface outwardly extending from the raised rim of the plate member, a substantially flat annular depression in the generally flat surface for receiving the base of a drinking vessel, a concave surface substantially concentric to the annular depression for supporting the bowl of a bowl-shaped stemmed drinking vessel, and a bight extending from the external edge of the vessel support member to an opening substantially concentric to the annular depression for allowing passage of the stem of the stemmed drinking vessel.

6. The plate assembly according to claim 5, wherein the grip member is separably attached to the plate member and the drinking vessel support member is separably attached to the plate member and further comprising means integral to an edge of the plate assembly for releasably holding a utensil, the holding means including a clip with opposing faces for providing pressure to grasp the utensil by frictional force.

7. The plate assembly according to claim 6, wherein the drinking vessel support member further comprises a soft covering on the portions of the annular depression and the concave surface potentially in contact with the drinking vessel for cushioning the drinking vessel.

8. The plate assembly according to claim 5, further comprising means intergral to an edge of the plate assembly for releasably holding a utensil, the holding means including a clip with opposing faces for providing pressure to grasp the utensil by frictional force.

9. The plate assembly according to claim 8, wherein said utensil is a napkin.

10. A plate assembly for supporting articles and a vessel, comprising:

a plate member having a substantially flat surface;

a grip member for holding the plate assembly in a hand and comprising an upwardly tilted flange extending from the plate member, an extending bulge extending from the underside portion of the plate member and cooperating with the upwardly tilted flange contoured for allowing the hand to cradle the plate assembly securely in the palm of the hand while stabilizing the plate assembly with the thumb of the hand communicating with the upwardly tilted flange; and a drinking vessel support member connected to a raised rim of the plate member and comprising a generally flat surface outwardly extending from the raised rim of the plate member, a substantially flat annular depression in the generally flat surface for receiving the base of a drinking vessel, a concave surface substantially concentric to the annular depression for supporting the bowl of a bowl-shaped stemmed drinking vessel, and a bight extending from the external edge of the vessel support member to an opening substantially concentric to the annular depression for allowing passage of the stem of the stemmed drinking vessel.

11. The plate assembly according to claim 10, wherein the grip member is separably attached to the plate member and the drinking vessel support member is separably attached to the plate member and further comprising means integral to an edge of the plate assembly for releasably holding a utensil, the holding means including a clip with opposing faces for providing pressure to grasp the utensil by frictional force.

12. The plate assembly according to claim 11, wherein the drinking vessel support member further comprises a soft covering on the portions of the annular depression and the concave surface potentially in contact with the drinking vessel for cushioning the drinking vessel.

13. The plate assembly according to claim 10, further comprising means integral to an edge of the plate assembly for releasably holding a utensil, the holding means including a clip with opposing faces for providing pressure to grasp the utensil by frictional force.

14. The plate assembly according to claim 13, wherein said utensil is a napkin.

* * * * *